US011536177B2

(12) United States Patent
Renault

(10) Patent No.: US 11,536,177 B2
(45) Date of Patent: Dec. 27, 2022

(54) EXHAUST GAS TEMPERATURE CONTROL

(71) Applicant: Carrier Corporation, Palm Beach Gardens, FL (US)

(72) Inventor: Loic Renault, Saint Etienne du Rouvray (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 180 days.

(21) Appl. No.: 16/962,431

(22) PCT Filed: Jan. 16, 2018

(86) PCT No.: PCT/IB2018/000118

§ 371 (c)(1),
(2) Date: Jul. 15, 2020

(87) PCT Pub. No.: WO2019/142011

PCT Pub. Date: Jul. 25, 2019

(65) Prior Publication Data

US 2021/0071557 A1 Mar. 11, 2021

(51) Int. Cl.
*F01N 3/00* (2006.01)
*F01N 3/035* (2006.01)
(Continued)

(52) U.S. Cl.
CPC ..... *F01N 3/035* (2013.01); *F01N 3/227* (2013.01); *F01N 3/30* (2013.01); *F01N 2560/06* (2013.01); *F01N 2900/1602* (2013.01)

(58) Field of Classification Search
CPC . F01N 3/035; F01N 3/227; F01N 3/30; F01N 2560/06; F01N 2900/1602; F01N 1/14; F01N 3/225; F01N 3/34
(Continued)

(56) References Cited

U.S. PATENT DOCUMENTS 3,967,929 A 7/1976 Tamazawa
5,331,809 A 7/1994 Takeshima
(Continued)

FOREIGN PATENT DOCUMENTS

DE 10345986 A1 4/2005
EP 1270888 A1 1/2003
(Continued)

OTHER PUBLICATIONS

English Translation of Japanese Patent Application Publication No. JP H08105319A (Oct. 1994) (Year: 1994).*
(Continued)

*Primary Examiner* — Matthew T Largi
(74) *Attorney, Agent, or Firm* — Cantor Colburn LLP

(57) ABSTRACT

An exhaust gas system is provided for a transport refrigeration unit (TRU) engine. The exhaust gas system includes an exhaust system. The exhaust system includes a catalyst operable in a temperature range to catalyze exhaust gas produced in the TRU engine and flown through the exhaust system. The exhaust gas system further includes temperature sensors respectively disposed to sense exhaust gas temperatures upstream of and downstream from the catalyst, at least one of first, second and third valves which are proportionally controllable to moderate amounts of air provided to the TRU engine, fuel provided to the TRU engine and air provided to the catalyst, respectively, and a controller. The controller is configured to compare sensed exhaust gas temperatures with the temperature range and issue a proportional signal to the at least one of the first, second and third valves in accordance with results of the comparison.

20 Claims, 2 Drawing Sheets

(51) Int. Cl.
*F01N 3/22* (2006.01)
*F01N 3/30* (2006.01)

(58) Field of Classification Search
USPC ..... 60/286
See application file for complete search history.

(56) References Cited

U.S. PATENT DOCUMENTS

| | | | | |
|---|---|---|---|---|
| 5,349,816 | A | 9/1994 | Sanbayashi | |
| 5,388,402 | A | 2/1995 | Aoki | |
| 5,388,403 | A | 2/1995 | Nagami | |
| 5,448,887 | A | 9/1995 | Shinichi | |
| 5,542,292 | A | 8/1996 | Schneider | |
| 5,983,628 | A | 11/1999 | Borroni-Bird | |
| 5,987,885 | A | 11/1999 | Kizer | |
| 5,996,338 | A | 12/1999 | Hirota | |
| 6,829,886 | B2 | 12/2004 | Nakata | |
| 7,487,633 | B2 | 2/2009 | Popik | |
| 8,479,501 | B2 | 7/2013 | McCarthy, Jr. | |
| 8,763,374 | B2 * | 7/2014 | Onishi | F01N 9/002 60/299 |
| 8,955,313 | B2 * | 2/2015 | Matsuo | B01J 35/0006 60/299 |
| 2007/0163246 | A1 * | 7/2007 | Wassmur | F01N 3/22 60/289 |
| 2007/0245725 | A1 | 10/2007 | Brown | |
| 2010/0000204 | A1 * | 1/2010 | Hemsley | F02B 37/164 60/299 |
| 2011/0016857 | A1 | 1/2011 | Batdorff | |
| 2011/0301826 | A1 * | 12/2011 | Galindo | F02M 21/0293 29/888.011 |
| 2012/0124995 | A1 | 5/2012 | Springer | |
| 2015/0184567 | A1 * | 7/2015 | Yamashita | B01D 53/9409 60/286 |
| 2015/0218989 | A1 * | 8/2015 | Kaneko | F02P 5/1506 60/286 |
| 2015/0338858 | A1 * | 11/2015 | Bates | B60H 1/00771 62/157 |
| 2021/0054772 | A1 * | 2/2021 | Williams | F01N 3/222 |

FOREIGN PATENT DOCUMENTS

| | | | |
|---|---|---|---|
| EP | 1491735 | A1 | 12/2004 |
| FR | 3001256 | A1 | 7/2014 |
| GB | 376124 | A | 7/1932 |
| JP | H08105319 | A * | 10/1994 |
| JP | H1162573 | A * | 8/1997 |
| JP | 2003201828 | A | 7/2003 |
| WO | 9423186 | A1 | 10/1994 |

OTHER PUBLICATIONS

English Translation of Japanese Patent Application Publication No. JP H1162573A (Aug. 1997) (Year: 1997).* http://www.team-bhp.com/forum/motorbikes/137475-secondary-air-injection-scooters-motorcycles.html Published Jun. 10, 2013; pp. 4.

International Search Report Application No. PCT/IB2018/000118; dated Mar. 28, 2018; pp. 2.

* cited by examiner

EXHAUST GAS TEMPERATURE CONTROL

CROSS-REFERENCE TO RELATED APPLICATIONS

This application is a National Phase of PCT Application No. PCT/IB2018/000118 filed Jan. 16, 2018 the disclosure of which is incorporated herein by reference in its entirety.

BACKGROUND

The following description relates to transport refrigeration units (TRUs) and, more specifically, to a system of exhaust gas temperature control for use with a TRU engine.

An engine system for a TRU typically includes a compressed natural gas (CNG) engine having a mixer at an inlet thereof and an exhaust manifold that directs exhaust to a catalyst (i.e., inside a catalytic converter) and then to an exhaust outlet. CNG, which is drawn from a supply tank and flows through a lock-off valve and a pressure regulator, is received by the inlet along with air from an air cleaner so that it can be combusted within the CNG engine. The lock-off valve is controlled by an output/input (O/I) steady state signal that is either on or off to allow CNG to flow or not, respectively.

With the typical configuration described above, operations of CNG engines provide for hot exhaust gas temperatures and employ the catalyst within a catalyst exhaust system to comply with emissions regulations. This catalyst exhaust system needs to run in a proper temperature range (e.g., ~300° C.-~800° C.), however, to allow for proper catalyst efficiency and insufficient exhaust gas temperatures lead to catalyst operations that do not comply with emissions regulations whereas over-temperature conditions can damage the catalyst material.

BRIEF DESCRIPTION

According to an aspect of the disclosure, an exhaust gas system is provided for a transport refrigeration unit (TRU) engine. The exhaust gas system includes an exhaust system. The exhaust system includes a catalyst operable in a temperature range to catalyze exhaust gas produced in the TRU engine and flown through the exhaust system. The exhaust gas system further includes temperature sensors respectively disposed to sense exhaust gas temperatures upstream of and downstream from the catalyst, at least one of first, second and third valves which are proportionally controllable to moderate amounts of air provided to the TRU engine, fuel provided to the TRU engine and air provided to the catalyst, respectively, and a controller. The controller is coupled to the temperature sensors and the at least one of the first, second and third valves and is configured to compare sensed exhaust gas temperatures with the temperature range and to issue a proportional signal to the at least one of the first, second and third valves in accordance with results of the comparison.

In accordance with additional or alternative embodiments, the TRU engine includes one of a gas engine, a compressed natural gas engine, a diesel engine.

In accordance with additional or alternative embodiments, the exhaust system includes an exhaust manifold through which the exhaust gas produced in the TRU engine flows toward the catalyst and an exhaust outlet through which the exhaust gas flows from the catalyst.

In accordance with additional or alternative embodiments, the temperature sensors include a first temperature sensor operably disposed in the exhaust manifold and a second temperature sensor operably disposed in the exhaust outlet.

In accordance with additional or alternative embodiments, each of at least one of the first and third valves includes a throttling valve.

In accordance with additional or alternative embodiments, the third valve is provided with a venturi element upstream from the catalyst.

In accordance with additional or alternative embodiments, the proportional signal issued by the controller includes a pulse width modulation signal (PWM).

In accordance with additional or alternative embodiments, the controller is configured to issue the proportional signal to the at least one of the first, second and third valves to maintain the exhaust gas temperatures in the temperature range.

According to another aspect of the disclosure, a transport refrigeration unit (TRU) is provided. The TRU includes an engine system and an exhaust system. The engine system includes an inlet to mix fuel and air and a TRU engine to combust the mixed fuel and air to produce exhaust gas which is flown through the exhaust system. The exhaust system includes a catalyst operable in a temperature range to catalyze the exhaust gas. The TRU further includes temperature sensors respectively disposed to sense exhaust gas temperatures upstream of and downstream from the catalyst, at least one of first, second and third valves which are proportionally controllable to moderate amounts of air provided to the TRU engine, fuel provided to the TRU engine and air provided to the catalyst, respectively, and a controller. The controller is coupled to the temperature sensors and the at least one of the first, second and third valves and is configured to compare sensed exhaust gas temperatures with the temperature range and to issue a proportional signal to the at least one of the first, second and third valves in accordance with results of the comparison.

In accordance with additional or alternative embodiments, the TRU engine includes one of a gas engine, a compressed natural gas engine, a diesel engine.

In accordance with additional or alternative embodiments, the exhaust system includes an exhaust manifold through which the exhaust gas produced in the TRU engine flows toward the catalyst and an exhaust outlet through which the exhaust gas flows from the catalyst.

In accordance with additional or alternative embodiments, the temperature sensors include a first temperature sensor operably disposed in the exhaust manifold and a second temperature sensor operably disposed in the exhaust outlet.

In accordance with additional or alternative embodiments, each of at least one of the first and third valves includes a throttling valve.

In accordance with additional or alternative embodiments, the third valve is provided with a venturi element upstream from the catalyst.

In accordance with additional or alternative embodiments, the proportional signal issued by the controller includes a pulse width modulation signal (PWM).

In accordance with additional or alternative embodiments, the controller is configured to issue the proportional signal to the at least one of the first, second and third valves to maintain the exhaust gas temperatures in the temperature range.

According to another aspect of the disclosure, a method of operating an exhaust gas system is provided for a transport refrigeration unit (TRU) engine. The method includes sensing exhaust gas temperatures proximate to a catalyst which is operable in a temperature range, comparing the sensed exhaust gas temperatures with the temperature range and issuing a proportional signal to at least one of first, second and third proportionally controllable valves to moderate amounts of air provided to the TRU engine, fuel provided to the TRU engine and air provided to the catalyst in accordance with results of the comparison.

In accordance with additional or alternative embodiments, the sensing includes sensing the exhaust gas temperatures upstream of and downstream from the catalyst.

In accordance with additional or alternative embodiments, each of the at least one of the first and third proportionally controllable valves includes a throttling valve and the proportional signal includes a pulse width modulation (PWM) signal.

In accordance with additional or alternative embodiments, the issuing includes issuing the proportional signal to the at least one of the first, second and third valves to maintain the exhaust gas temperatures in the temperature range.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

These and other advantages and features will become more apparent from the following description taken in conjunction with the drawings.

DETAILED DESCRIPTION

As will be described below, air and gas flows in a CNG engine system are both managed to optimize efficiency and reliability of the engine exhaust system and to increase the likelihood that the catalyst exhaust system runs in an appropriate exhaust gas temperature range. To this end, a TRU is equipped with an engine system to drive a TRU cooling system. The engine system can include an engine, such as a gasoline powered engine, a CNG powered engine, a diesel fuel powered engine or a natural gas powered engine. The engine system further includes an exhaust gas system. The exhaust gas system includes a catalyst, exhaust gas temperature sensors upstream of and downstream from the catalyst, an electrically driven throttle valve to control or throttle flows of air into an inlet of the engine, a bypass at the exhaust gas system inlet (i.e., upstream from the catalyst) to allow outside air to mix with exhaust gas, an electrically driven throttle valve to control or throttle flows of air into an inlet of the catalyst and a venturi at the inlet of the catalyst to generate a Bernoulli low pressure condition which effectively pulls outside air through an air cleaner and the catalyst. The exhaust gas system further includes a proportional electrically driven fuel lock off-valve that can be proportionally electrically driven to control or throttle flows of fuel into the engine and a controller. The controller monitors exhaust gas temperatures and manages each throttle valve and the fuel lock-off valve accordingly.

Figure 1:
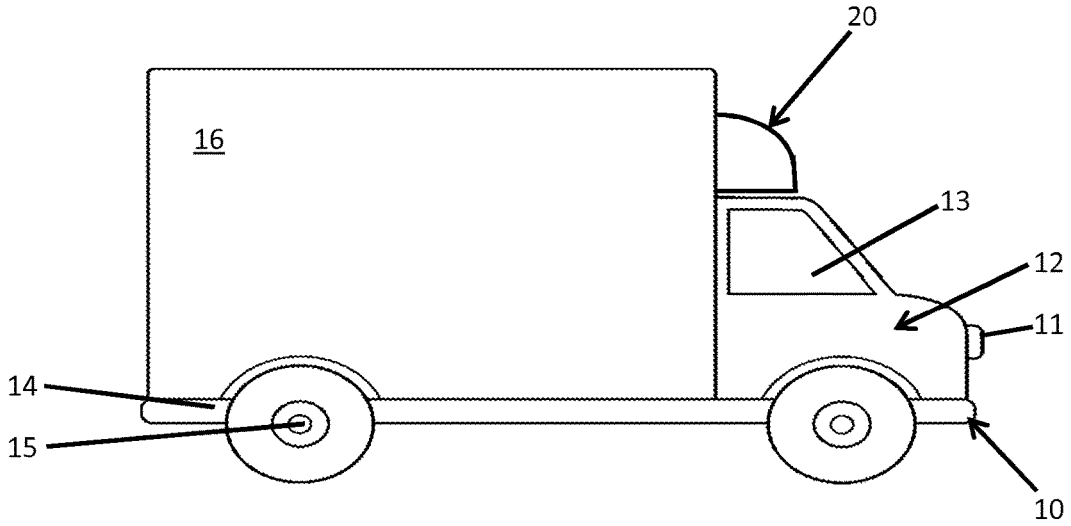
FIG. 1 is a schematic diagram of a vehicle with a transport refrigeration unit (TRU) in accordance with embodiments.

With reference to FIG. 1, a vehicle 10 is provided for transport and delivery of certain items requiring environmental control during shipment. The vehicle 10 may be configured as a truck 11 with an engine 12, a passenger compartment 13, a chassis and a truck bed 14, wheels 15 and a container 16 in which the items requiring environmental control are accommodated during shipment. The vehicle 10 may further include a transport refrigeration unit (TRU) 20. The TRU 20 is coupled to the container 16 and is configured to provide for the environmental control required by the items during shipment within an interior of the container 16.

Figure 2:
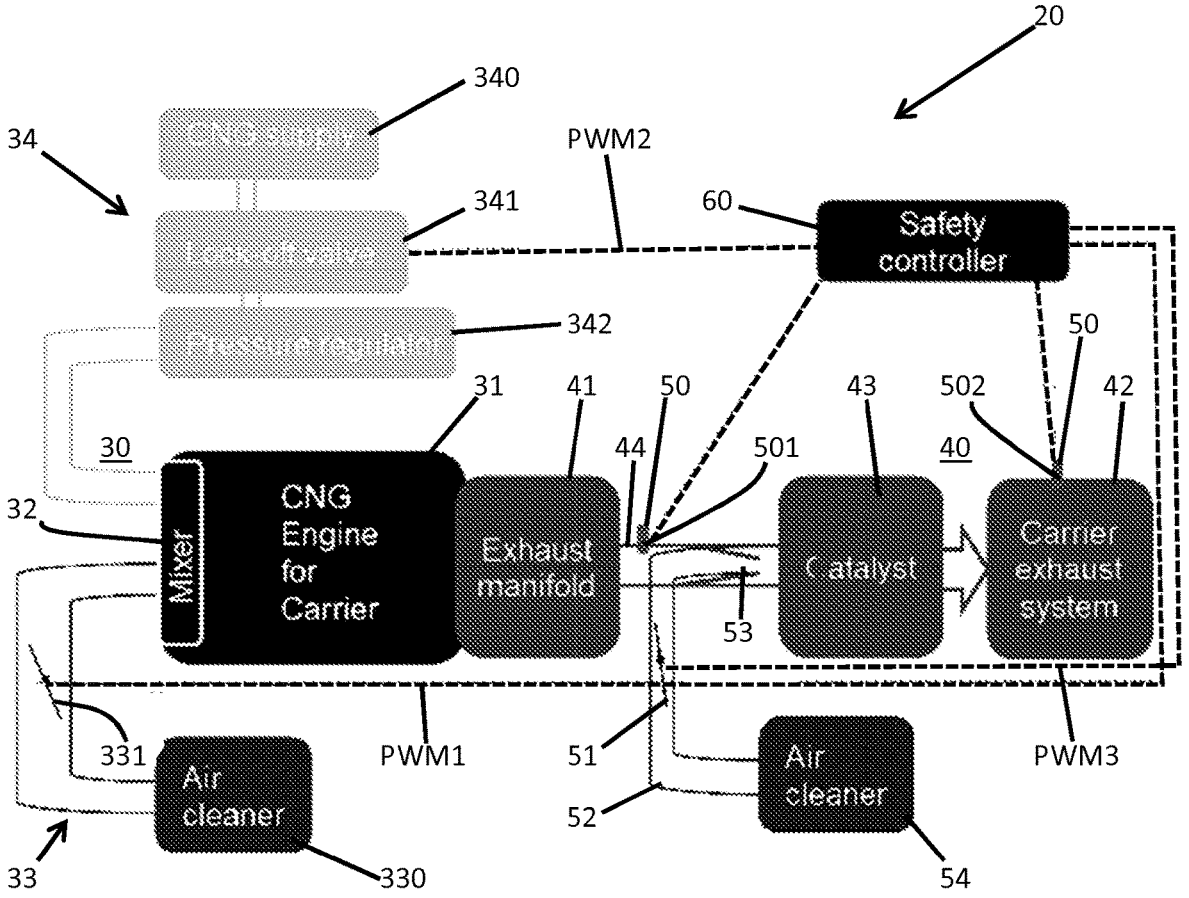
FIG. 2 is a schematic illustration of components of a TRU engine in accordance with embodiments.

With reference to FIG. 2, the TRU 20 of FIG. 1 includes an engine system 30 and an exhaust system 40.

The engine system 30 includes a TRU engine 31, which may include or be configured as one or more of a gas engine, a compressed natural gas (CNG) engine, a diesel engine, etc., a mixer or an inlet 32, an air supply portion 33 and a fuel supply portion 34. The air supply portion 33 includes an air cleaner 330 and a first valve 331. During operations of the TRU engine 31, air is drawn into the inlet 32 through the air cleaner 330 and the first valve 331 (an operation of the first valve 331 will be described in further detail below). The fuel supply portion 34 includes a fuel supply tank (e.g., a CNG supply as shown in FIG. 2) 340, a lock-off or second valve 341 and a pressure regulator 342. During operations of the TRU engine 31, fuel that is accommodated in the fuel supply tank 340 is drawn into the inlet 32 by way of the second valve 341 and the pressure regulator 342 (an operation of the second valve 341 will be described in greater detail below). Within the inlet 32, the air and the fuel are mixed for combustion within the TRU engine 31 whereupon the TRU engine 31 drives operations of the TRU 20 from the production of high temperature and high pressure exhaust gas.

The exhaust gas produced by the TRU engine 31 is flown through the exhaust system 40. To this end, the exhaust system 40 includes an exhaust manifold 41, which is directly downstream from the TRU engine 31, an exhaust outlet 42, a catalyst 43, which is fluidly interposed between the exhaust manifold 41 and the exhaust outlet 42 and a duct 44. Exhaust gases travel through the duct 44 from the exhaust manifold 41 to the catalyst 43. The catalyst 43 is operated to catalyze the exhaust gases to thereby break down certain pollutants included therein in order to meet emissions requirements. The catalyst is properly operable is a defined temperature range (e.g., from ~300° C.-~800° C.) of the exhaust gas since exhaust gases that are too cool may lead to an underperformance of the catalyst 43 and since exhaust gases that are too hot may damage the catalyst 43.

Thus, as will be described below, the TRU 20 further includes additional components which are configured to monitor temperatures of the exhaust gases and to take actions that are designed to optimize TRU operations by either increasing exhaust gas temperatures in an event the monitored exhaust gas temperatures are too low or by decreasing exhaust gas temperatures in an event the monitored exhaust gas temperatures are too high.

Still referring to FIG. 2, the TRU 20 includes temperature sensors 50, at least one of the first valve 331, the second valve 341 and a third valve 51 and a controller 60. The temperature sensors 50 are respectively disposed to sense exhaust gas temperatures and may include a first exhaust gas temperature sensor 501, which is disposed upstream of the catalyst 43 to sense exhaust gas temperatures in the duct 44, and a second exhaust gas temperature sensor 502, which is disposed downstream from the catalyst 43 to sense exhaust gas temperatures in the exhaust outlet 42. The at least one of the first valve 331, the second valve 341 and the third valve 51 is proportionally controllable to moderate amounts of air provided to the TRU engine 31, to moderate amounts of fuel provided to the TRU engine 31 and to moderate amounts of air provided to the catalyst 32, respectively. The controller 60 is coupled to the temperature sensors 50 and the at least one of the first valve 331, the second valve 341 and the third valve 51. The controller 60 is configured to compare sensed exhaust gas temperatures, as sensed by the first and second exhaust gas temperature sensors 501 and 502, with the temperature range in which the catalyst 43 is properly operable and to issue a proportional signal to the at least one of the first valve 331, the second valve 341 and the third valve 51 in accordance with results of the comparison.

In accordance with embodiments, the first valve 331 may be configured or provided within a duct 332 that is arranged upstream from the inlet 32 and may include or be provided as an air throttling valve or another suitable type of valve that opens and closes the duct 332 in accordance with the signal issued by the controller 60. For example, the signal issued thereto by the controller 60 may be configured as a pulse width modulation (PWM) signal PWM1 that effectively instructs the first valve 331 to open the duct 332 by a particular angle. In such cases, the greater the particular angle the more air flows into the inlet 32 and the higher the exhaust gas temperatures are whereas the lesser the particular angle the less air flows into the inlet 32 and the lower the exhaust gas temperatures are.

That is, when the controller 60 recognizes that the temperature sensors 50 sense that the exhaust gas temperatures are too low relative to the temperature range in which the catalyst 43 is properly operable, the controller 60 will issue the PWM signal PWM1 such that the first valve 331 opens toward a greater angle and the duct 332 correspondingly opens. This allows more air to flow into the inlet 32 and thus increases the temperatures of the exhaust gases. On the other hand, when the controller 60 recognizes that the temperature sensors 50 sense that the exhaust gas temperatures are too high relative to the temperature range in which the catalyst 43 is properly operable, the controller 60 will issue the PWM signal PWM1 such that the first valve 331 closes toward a lesser angle and the duct 332 correspondingly closes. This decreases the amount of air permitted to flow into the inlet 32 and thus decreases the temperatures of the exhaust gases.

In accordance with embodiments, the second valve 341 may be configured or provided as a component of the lock-off valve and is arranged upstream from the inlet 32. In some cases, the second valve 341 may include or be provided as an air throttling valve or another suitable type of valve that opens and closes in accordance with the signal thereto issued by the controller 60. For example, the signal issued by the controller 60 may be configured as a PWM signal PWM2 that effectively instructs the second valve 341 to open by a particular angle. In such cases, the greater the particular angle the more fuel flows into the inlet 32 and the higher the exhaust gas temperatures are whereas the lesser the particular angle the less fuel flows into the inlet 32 and the lower the exhaust gas temperatures are.

That is, when the controller 60 recognizes that the temperature sensors 50 sense that the exhaust gas temperatures are too low relative to the temperature range in which the catalyst 43 is properly operable, the controller 60 will issue the PWM signal PWM2 such that the second valve 341 opens toward a greater angle and allows more fuel to flow into the inlet 32 and thus increases the temperatures of the exhaust gases. On the other hand, when the controller 60 recognizes that the temperature sensors 50 sense that the exhaust gas temperatures are too high relative to the temperature range in which the catalyst 43 is properly operable, the controller 60 will issue the PWM signal PWM2 such that the second valve 341 closes toward a lesser angle and decreases the amount of air permitted to flow into the inlet 32 and thus decreases the temperatures of the exhaust gases.

In accordance with embodiments, the third valve 51 may be configured or provided within a duct 52 that is arranged upstream from the catalyst 43 and may include or be provided as an air throttling valve or another suitable type of valve that opens and closes the duct 52 in accordance with the signal issued thereto by the controller 60. An end of the duct 52 may be provided or configured as a venturi element 53 which generates a Bernoulli effect to draw air through an air cleaner 54 and the duct 52. The signal issued to the third valve 51 by the controller 60 may be configured as a PWM signal PWM3 that effectively instructs the third valve 51 to open the duct 52 by a particular angle. In such cases, the greater the particular angle the more air flows into the catalyst 43 and the lower the exhaust gas temperatures are whereas the lesser the particular angle the less air flows into the catalyst 43 and the higher the exhaust gas temperatures are.

That is, when the controller 60 recognizes that the temperature sensors 50 sense that the exhaust gas temperatures are too low relative to the temperature range in which the catalyst 43 is properly operable, the controller 60 will issue the PWM signal PWM3 such that the third valve 51 closes toward a lesser angle and the duct 52 correspondingly closes. This allows less air to flow into the catalyst 43 and thus increases the temperatures of the exhaust gases. On the other hand, when the controller 60 recognizes that the temperature sensors 50 sense that the exhaust gas temperatures are too high relative to the temperature range in which the catalyst 43 is properly operable, the controller 60 will issue the PWM signal PWM3 such that the third valve 51 opens toward a greater angle and the duct 52 correspondingly opens. This increases the amount of air permitted to flow into the catalyst 43 and thus decreases the temperatures of the exhaust gases.

In accordance with embodiments, the controller 60 may be configured to issue the PWM signals PWM1, PWM2 and PWM3 concurrently, sequentially, alone or in various combinations thereof in order to maintain the exhaust gas temperature range within the temperature range in which the catalyst 43 is properly operable, to maintain the exhaust gas temperature range within another temperature range that is partially or fully nested within the temperature range in which the catalyst 43 is properly operable or to optimize a performance of the catalyst 43 according to various performance characteristics.

Figure 3:
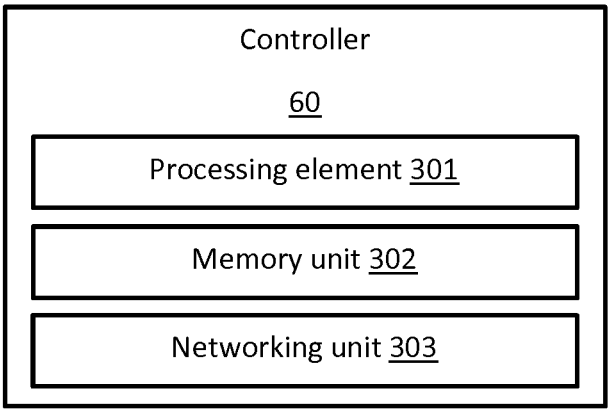
FIG. 3 is a schematic diagram illustrating components of a controller of the components of the TRU engine of FIG. 2.

With reference to FIG. 3, the controller 60 may be provided or configured as a safety controller and may include a processing element 301, a memory unit 302 and a networking unit 303. The processing element 301 is communicative with the temperature sensors 50 and the at least one of the first valve 331, the second valve 341 and the third valve 51 by way of the networking unit 303. The memory unit 302 has executable instructions stored thereon, which, when executed, cause the processing element 301 to operate effectively as a central processing unit (CPU) of the controller 60 such that the controller 60 operates substantially as described herein.

Figure 4:
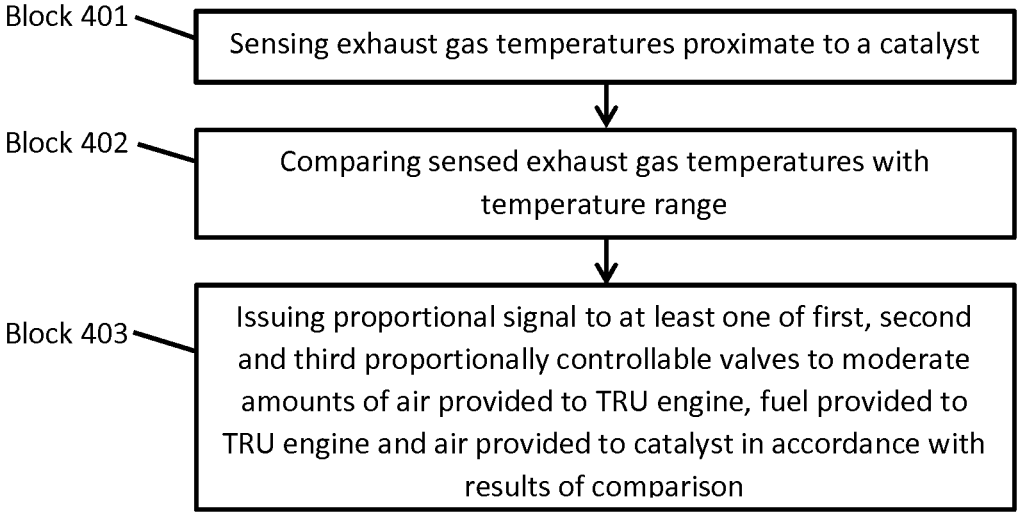
FIG. 4 is a flow diagram illustrating a method of operating of operating an exhaust gas system for a TRU in accordance with embodiments.

With reference to FIG. 4, a method of operating an exhaust gas system for a transport refrigeration unit (TRU) engine is provided. The method includes sensing exhaust gas temperatures proximate to a catalyst which is operable in a temperature range (block 401), comparing the sensed exhaust gas temperatures with the temperature range (block 402) and issuing a proportional signal to at least one of first, second and third proportionally controllable valves to moderate amounts of air provided to the TRU engine, fuel provided to the TRU engine and air provided to the catalyst in accordance with results of the comparison (block 403).

The systems and methods described herein provide for management of both air and gas flows at an engine inlet in order to control exhaust gas temperatures and, more particularly, to avoid exhaust gas over-temperature conditions, for extending catalyst lifetime and for providing for a fast warm-up of the catalyst. The systems and methods described herein also ensure that the catalyst runs at its appropriate minimum and maximum temperatures and that the TRU's engine complies with emissions regulations.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. An exhaust gas system for a transport refrigeration unit (TRU) engine, comprising:

an exhaust system comprising a catalyst operable in a temperature range to catalyze exhaust gas produced in the TRU engine and flown through the exhaust system;

temperature sensors respectively disposed to sense exhaust gas temperatures upstream of and downstream from the catalyst;

first, second and third valves, each of which is proportionally controllable to moderate amounts of air provided to the TRU engine, fuel provided to the TRU engine and air provided to the catalyst, respectively, the first and second valves being disposed in parallel upstream from the TRU engine; and a controller coupled to the temperature sensors and each of the first, second and third valves and configured to:

compare sensed exhaust gas temperatures with the temperature range, and issue first, second and third proportional signals to each of the first, second and third valves, respectively, in accordance with results of the comparison.

2. The exhaust gas system according to claim 1, wherein the TRU engine comprises at least one of a gas engine, a compressed natural gas engine and a diesel engine.

3. The exhaust gas system according to claim 1, wherein the exhaust system comprises:

an exhaust manifold through which the exhaust gas produced in the TRU engine flows toward the catalyst; and an exhaust outlet through which the exhaust gas flows from the catalyst.

4. The exhaust gas system according to claim 3, wherein the temperature sensors comprise:

a first temperature sensor operably disposed in the exhaust manifold; and a second temperature sensor operably disposed in the exhaust outlet.

5. The exhaust gas system according to claim 1, wherein:

each of the first and third valves comprises a throttling valve, the first valve is interposed between a compressed natural gas (CNG) supply and a pressure regulator, and each of the second and third valves is disposed within a duct and downstream from an air cleaner.

6. The exhaust gas system according to claim 5, wherein the third valve is provided with a venturi element disposed at an end of the corresponding duct and upstream from the catalyst.

7. The exhaust gas system according to claim 5, wherein each of the first, second and third proportional signals issued by the controller comprises a pulse width modulation signal (PWM).

8. The exhaust gas system according to claim 5, wherein the controller is configured to issue each of the first, second and third proportional signals to each corresponding one of the first, second and third valves, respectively, to maintain the exhaust gas temperatures in the temperature range.

9. A transport refrigeration unit (TRU), comprising:

an engine system comprising an inlet to mix fuel and air and a TRU engine to combust the mixed fuel and air to produce exhaust gas;

an exhaust system through which the exhaust gas is flown and comprising a catalyst operable in a temperature range to catalyze the exhaust gas;

temperature sensors respectively disposed to sense exhaust gas temperatures upstream of and downstream from the catalyst;

first, second and third valves, each of which is proportionally controllable to moderate amounts of air provided to the TRU engine, fuel provided to the TRU engine and air provided to the catalyst, respectively, the first and second valve being disposed in parallel upstream from the TRU engine; and a controller coupled to the temperature sensors and each of the first, second and third valves and configured to:

compare sensed exhaust gas temperatures with the temperature range, and issue first, second and third proportional signals to each of the first, second and third valves, respectively, in accordance with results of the comparison.

10. The exhaust gas system according to claim 9, wherein the TRU engine comprises at least one of a gas engine, a compressed natural gas engine and a diesel engine.

11. The exhaust gas system according to claim 9, wherein the exhaust system comprises:

an exhaust manifold through which the exhaust gas produced in the TRU engine flows toward the catalyst; and an exhaust outlet through which the exhaust gas flows from the catalyst.

12. The exhaust gas system according to claim 11, wherein the temperature sensors comprise:

a first temperature sensor operably disposed in the exhaust manifold; and a second temperature sensor operably disposed in the exhaust outlet.

13. The exhaust gas system according to claim 9, wherein:

each of the first and third valves comprises a throttling valve, the first valve is interposed between a compressed natural gas (CNG) supply and a pressure regulator, and each of the second and third valves is disposed within a duct and downstream from an air cleaner.

14. The exhaust gas system according to claim 13, wherein the third valve is provided with a venturi element disposed at an end of the corresponding duct and upstream from the catalyst.

15. The exhaust gas system according to claim 13, wherein each of the first, second and third proportional signals issued by the controller comprises a pulse width modulation signal (PWM).

16. The exhaust gas system according to claim 13, wherein the controller is configured to issue each of the first, second and third proportional signals to each corresponding one of the first, second and third valves, respectively, to maintain the exhaust gas temperatures in the temperature range.

17. A method of operating an exhaust gas system for a transport refrigeration unit (TRU) engine, the method comprising:

arranging first and second proportionally controllable valves in parallel upstream from the TRU engine, the first and second proportionally controllable valves being configured to moderate amounts of air and fuel provided to the TRU engine, respectively;

arranging a third proportionally controllable valve upstream from a catalyst, the third proportionally controllable valve being configured to moderate an amount of air provided to the catalyst;

sensing exhaust gas temperatures proximate to the catalyst which is operable in a temperature range;

comparing the sensed exhaust gas temperatures with the temperature range; and issuing first, second and third proportional signals to each of the first, second and third proportionally controllable valves, respectively, to moderate the amounts of air provided to the TRU engine, fuel provided to the TRU engine and air provided to the catalyst respectively, in accordance with results of the comparison.

18. The method according to claim 17, wherein the sensing comprises sensing the exhaust gas temperatures upstream of and downstream from the catalyst.

19. The method according to claim 17, wherein:

each of the first and third proportionally controllable valves comprises a throttling valve and the proportional signal comprises a pulse width modulation (PWM) signal, the first proportionally controllable valve is interposed between a compressed natural gas (CNG) supply and a pressure regulator, each of the second and third valves is disposed within a duct and downstream from an air cleaner, and the third valve is provided with a venturi element disposed at an end of the corresponding duct and upstream from the catalyst.

20. The method according to claim 19, wherein the issuing comprises issuing each of the first, second and third proportional signals to each corresponding one of the first, second and third valves, respectively, to maintain the exhaust gas temperatures in the temperature range.

* * * * *